US006626334B2

(12) United States Patent
Ewing

(10) Patent No.: US 6,626,334 B2
(45) **Date of Patent: *Sep. 30, 2003**

(54) BODY MOUNTED MARKER HOLDER

(76) Inventor: Stephan C. Ewing, 1820 Old Waterman Rd., San Bernardino, CA (US) 92404

( * ) Notice: Subject to any disclaimer, the term of this patent is extended or adjusted under 35 U.S.C. 154(b) by 13 days.

This patent is subject to a terminal disclaimer.

(21) Appl. No.: 09/912,007

(22) Filed: Jul. 24, 2001

(65) Prior Publication Data

US 2002/0017540 A1 Feb. 14, 2002

Related U.S. Application Data

(63) Continuation-in-part of application No. 09/309,204, filed on May 10, 1999, now Pat. No. 6,264,080.

(51) Int. Cl.[7] ..... A45F 5/00

(52) U.S. Cl. ..... 224/200; 224/197; 224/249; 224/251; 224/269; 24/11 R; 401/98; 401/202

(58) Field of Search ..... 224/260, 197, 224/249, 251, 269; 24/11 R; 401/98, 202

(56) References Cited

U.S. PATENT DOCUMENTS

| | | | |
|---|---|---|---|
| 33,894 | A | 12/1861 | Lord |
| 301,122 | A | 7/1884 | Hicks |
| 762,922 | A | 6/1904 | Meyerpeter |
| 863,029 | A | 8/1907 | Holland |
| 1,064,788 | A | 6/1913 | Terry |
| 1,088,406 | A | 2/1914 | Davis |
| 1,281,299 | A | 10/1918 | Crosson |
| 2,415,208 | A | 2/1947 | Greenberg |
| 2,859,516 | A | 11/1958 | McQueary |
| 3,056,180 | A | 10/1962 | Gink |
| 4,262,833 | A | 4/1981 | De Santis |
| 4,391,457 | A | 7/1983 | Gassner |
| D276,479 | S | 11/1984 | Mori |
| 4,564,078 | A | 1/1986 | Enokido et al. |
| 4,674,298 | A | 6/1987 | Wimmershoff-Caplan |
| 4,756,458 | A | 7/1988 | Clifton |
| 4,830,248 | A | 5/1989 | Pommenville |
| 4,893,739 | A | 1/1990 | Conner |
| 5,386,932 | A | 2/1995 | Gross |
| 5,477,999 | A | 12/1995 | Blankenship, Jr. |

FOREIGN PATENT DOCUMENTS

| | | |
|---|---|---|
| GB | 20226 | 11/1894 |
| GB | 25440 | 11/1894 |
| GB | 437677 | 11/1935 |
| GB | 650540 | 7/1950 |
| IT | 805654 | 11/1936 |

*Primary Examiner*—Stephen K. Cronin

(57) ABSTRACT

A cap of a marking device such as a felt tip marker is attached by a cap retaining device adjacent the body of a user. The barrel or marking portion of the marking device may then be readily removed, used for marking and then reinserted into the cap using only a single hand.

41 Claims, 13 Drawing Sheets

FIG. 7
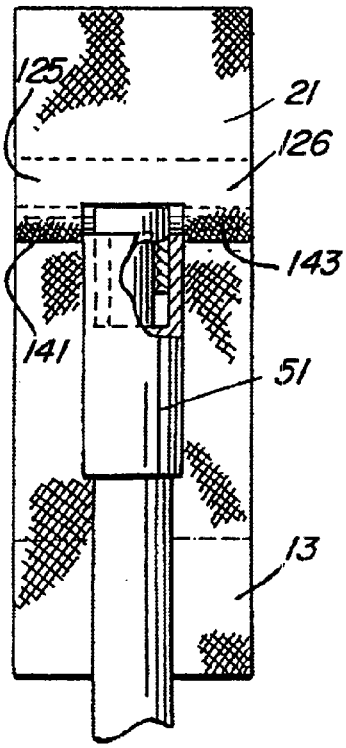
FIG. 8
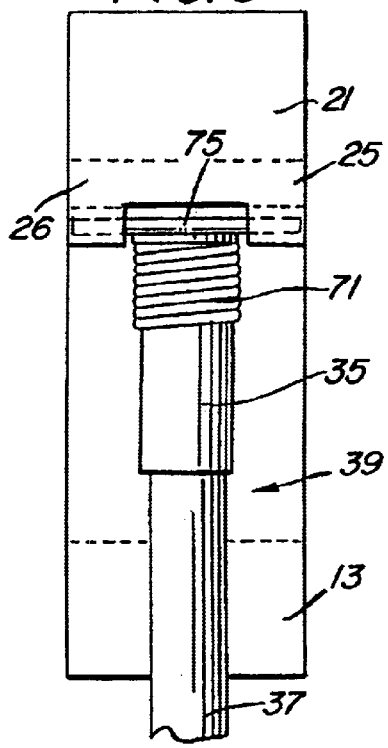
FIG. 9
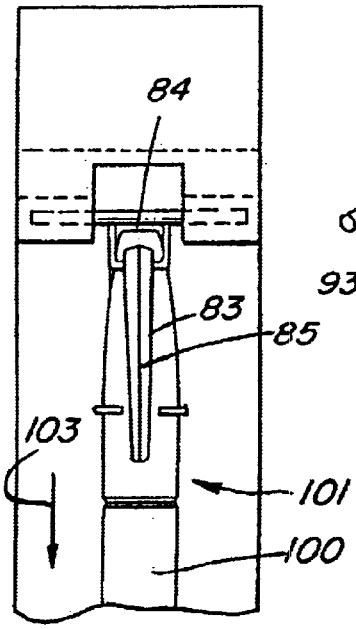
FIG. 10
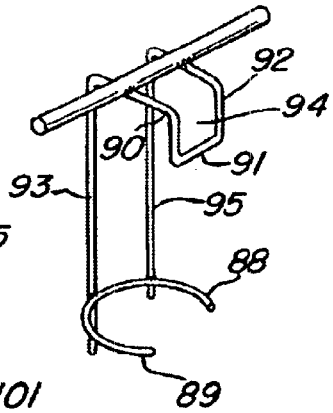
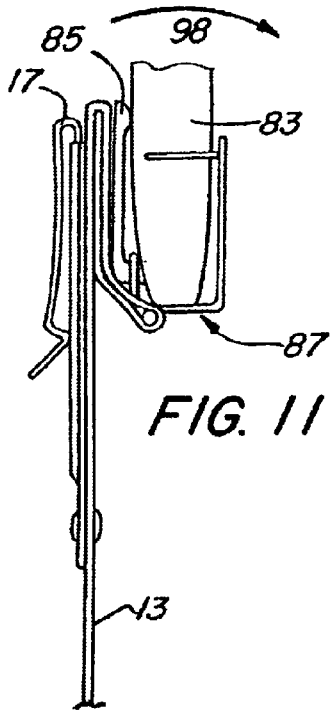
FIG. 11

BODY MOUNTED MARKER HOLDER

RELATED APPLICATIONS

This application is a continuation-in-part of U.S. patent application Ser. No. 09/309,204, filed May 10, 1999 now U.S. Pat. No. 6,264,080.

BACKGROUND OF THE INVENTION

1. Field of the Invention

The subject invention relates generally to holders for marking devices and more particularly to apparatus readily adaptable for mounting conventional marking devices adjacent the body of a user, and particularly such marking devices as typically employed in the construction industry.

2. Description of Related Art

Marking devices are commonly used in many occupations for marking, drawing or writing. Such devices include, for example, felt tip pens, paint pens and artist pens. Construction workers, warehouse workers and postal employees are just a few examples of users of such devices.

Such marking devices typically consist of two parts: (1) a stick, barrel or marker portion having a tip and (2) an airtight cap which snaps or press fits onto the stick portion. They are often carried in a shirt or pants pocket or a tool belt pouch. Typically, before use, the user must locate and pick up the marker, then grip the barrel of the marker in one hand while gripping the cap in the other hand in order to pull the cap off. This procedure leads to a number of problems.

For example, in the case of construction workers, a marker is often used in conjunction with a measuring tape to measure a piece of building material to be cut to a certain size. The worker first applies the tape to the piece of building material. Next, the worker must mark the material for cutting. To mark the material, the worker must remove the marker from his or her pocket or carrying pouch and then remove the cap from the marker. At present, the cap is often removed by placing the marker cap in the worker's mouth, biting the cap, and pulling the marker barrel free, all the while struggling to keep the measuring tape in its proper place with the other hand. The difficulty of executing this maneuver is often compounded by the fact that the worker may be measuring atop a ladder. Moreover, in the course of executing such maneuvers, the cap is often laid aside and lost.

One might suppose that such difficulties could be avoided by removing the cap first before measuring. This approach is not usually practical either, because it is usually necessary to use both hands in order to extract and hook the end of the measuring tape, especially with long measurements.

SUMMARY OF THE INVENTION

According to the invention, apparatus is provided for retaining the cap of a marking device adjacent the body of a user while the marking portion of the device is in use. The present invention facilitates (but does not require) convenient one-handed use of felt-tip and other marking pens.

The invention further contemplates a method of using a marking stick designed to be inserted into a cap comprising the steps of attaching a cap adjacent the body of a user of the stick, inserting the stick into the cap, and withdrawing the stick from the cap when it is desired to use the stick for marking purposes.

BRIEF DESCRIPTION OF THE DRAWINGS

The objects and features of the present invention, which are believed to be novel, are set forth with particularity in the appended claims. The present invention, both as to its organization and manner of operation may be best understood by reference to the following description, taken in connection with the accompanying drawings.

FIG. 7 is a partial front view of an alternate embodiment for use with the second style marker device;

FIG. 8 is a partial front view of an alternate embodiment for holding marking devices like those shown in FIGS. 2 and 3 or 7;

FIG. 9 is a front view illustrating a third embodiment useable with a third style marking device;

FIG. 10 is a perspective view illustrating the marking device retainer component of the embodiment of FIG. 9;

FIG. 11 is a partial side view useful in illustrating operation of the embodiment of FIGS. 9 and 10.

DETAILED DESCRIPTION OF THE PREFERRED EMBODIMENTS

Figure 1:
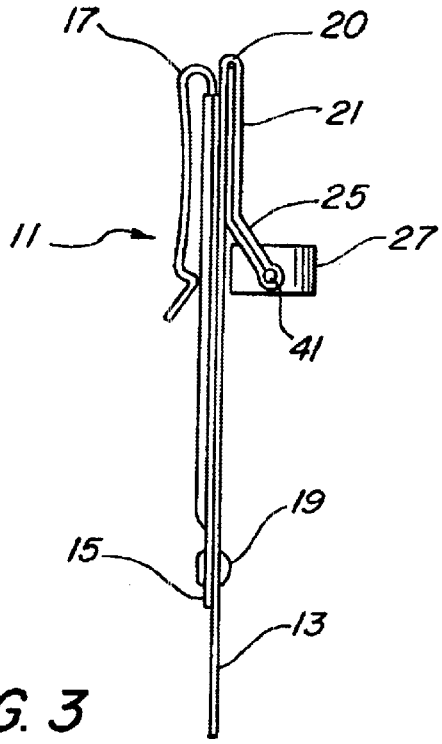
FIG. 1 is a side view of a marker holder according to the preferred embodiment.

The following description is provided to enable any person skilled in the art to make and use the invention and sets forth the best modes contemplated by the inventor of carrying out his invention. Various modifications, however, will remain readily apparent to those skilled in the art.

FIGS. 1–4 illustrate a first preferred embodiment marker holder 11 for use with a first style marking device 39. The marking device 39 includes a cap 35, which typically snaps onto a marking portion or body 37 of the device 39. Typical of the marking devices 39 which may be retained by the embodiment of FIGS. 1–4 are the marking devices sold under the trademark "HI-LITER®."

As shown in FIG. 1, the holder device 11 includes a main body piece 13, a retainer flap 15 and a mounting clip 17. The main body piece 13 and retainer flap 15 may be fabricated of sturdy fabric, such as leather, cloth or synthetic material, including woven poly or nylon webbing.

The main body piece 13 is folded over at bend 20 to create downturned flap portion 21. The main body piece 13 is then folded back on itself and suitably cut to create two depending flaps 25, 26, defined at their top-most edge by a stitch line 23. At the stitch line 23, the downturned portion 21 is stitched to the portion of the main body piece 13 lying behind portion 21.

Figure 2:
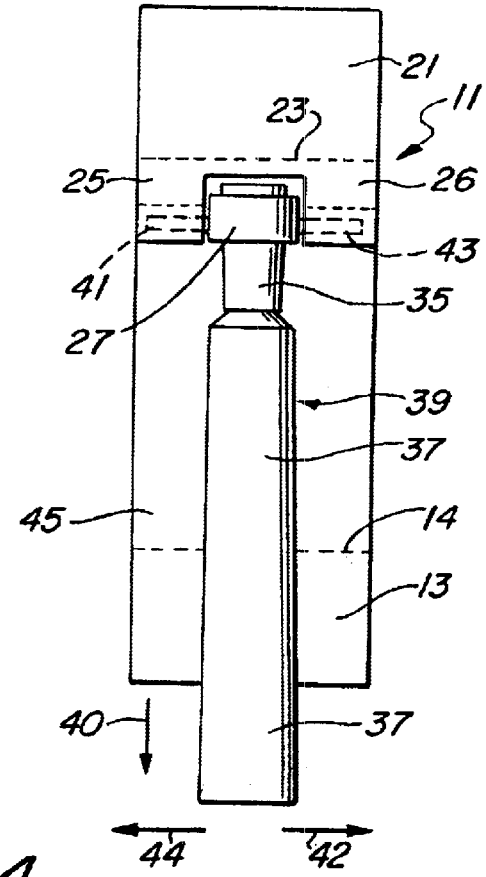
FIG. 2 is a front view of the holder of FIG. 1, with a marking device installed.
Figure 3:
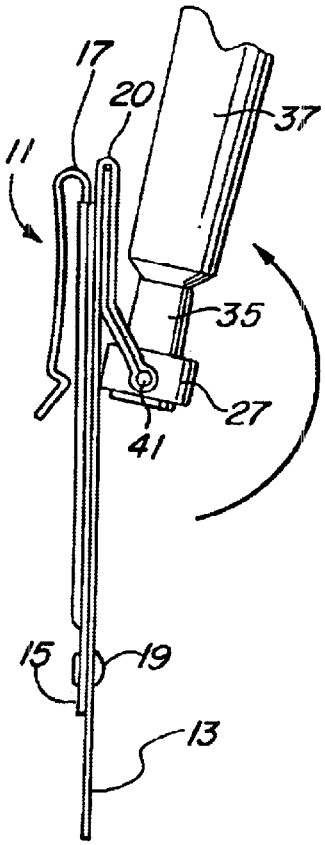
FIG. 3 is a partial side view of the holder of FIG. 1, illustrating the holder nut rotated 180° degrees in preparation for insertion of the marking portion of the marking device into the cap of the device.
Figure 4:
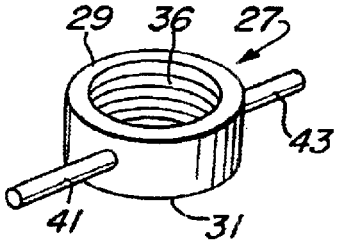
FIG. 4 is a perspective view of the nut or cap retainer component of the device of FIG. 1.

As best seen in FIG. 2, the folds of the depending flap portions 25, 26 accommodate respective pivot arms 41, 43 which are welded or otherwise fixably attached to a metal nut 27. The nut 27 has a top edge 29, a bottom edge 31 and is internally threaded as illustrated in FIG. 4.

The retainer flap 15 is stitched to the main body piece 13 along stitch line 14 and glued elsewhere along its edges to the main body piece 13. The retainer clip 17 includes a vertical depending portion (not shown) which is sandwiched by the main body piece 13 and retainer flap 15. All three of these pieces 13, 15, 17 are further fastened together by a rivet 19 or other suitable manner of fastening.

In operation, the cap 35 is removed from the body 37 of the marking device and inserted downwardly through the nut 27 to assume the position shown in FIG. 2. The nut 27 retains the cap 35.

Since the cap 35 is formed of relatively soft plastic, it may be screwed into the nut 27 in such a fashion that the threads 36 bite into and retain the plastic cap 35. In this aspect, the threads 36 of the device may be considered as being "self-tapping" and the cap 35 may be said to interlock with the nut 27. With the cap 35 preferably in the position illustrated in FIG. 3, the body 37 of the marking device 39 is then snap-fitted back into cap 35 and is ready for use.

When it is desired to use the marking device 39, the marking portion of the device 37 may be extracted by pulling it vertically downward in the direction of the arrow 40 (FIG. 2) to expose the tip of the marking portion 37 of the device 39. When use of the marking portion 37 is complete the marking portion 37 is simply reinserted by snapping it into the cap 35 which still remains attached to nut 27. Such reinsertion may best be accomplished when the cap 35 is in the position shown in FIG. 3. It will be apparent that the marking portion 37 can be extracted for use in the downward position shown in FIG. 2 or at any desired angle between the downward position of FIG. 2 and the vertical position of FIG. 3, if desired. The nut 27 may also have a funnel-shaped (conically tapered) threaded interior. Such an interior may more suitably accommodate caps 35 which are wider at the top than the bottom and can be inverted to accommodate caps which are narrower at the top than at the bottom.

It may be noted that the flexible nature of the fabric employed in fabrication of the preferred embodiment permits the marking device to move sidewardly in the direction of either of the arrows 42 or 44 in FIG. 2. Such sideward flexibility can also be provided by pivotally mounting the cap or cap-retaining component to pivot sidewardly, i.e., clockwise or counterclockwise. For example, pivot arms 41, 43 can be attached to a plate, which is in turn pivotally mounted to the clip 17. Sideward flexibility together with the pivotal nature of the mounting of the nut 27 permits the device to be clipped to a belt via clip 17 and to then adapt to user movements, for example, to move from one side to the other when the user sits down. Another advantage is that the extended or apron portion 45 of the main body piece 13 provides protection against marking of the user's clothing when the marking portion 37 is being extracted.

If desired, a simpler embodiment can be provided wherein only a clip 17, an apron portion, and a cap mounting/retaining device are employed. In such an embodiment, the apron may be a piece of material having a top edge attached to a rivet such as rivet 19 and a cap retaining device attached directly to the clip 17.

It may be further noted that the cap portion 35 could be a permanent metallic piece attached to the nut 27 or formed as a unitary part thereof, in which case multiple body portions 37 could be inserted into such a cap portion 35 with their conventional plastic cap being discarded. The unitary, metallic cap portion 35 would be connected to pivot arms 41, 43 so as to allow the cap potion 35 to pivot about an axis extending through co-linear pivot arms 41, 43. The marker cap 35 may either be rigidly attached to the pivot arms 41, 43 or may be free to move laterally along a longitudinal direction of the axis extending through the pivot arms 41, 43. Furthermore, while FIGS. 1–4 illustrate a marker holder apparatus which is particularly suited to be clipped to a belt, it should be appreciated that suitable or equivalent components of the disclosed marker holder apparatus could also be formed as part of a tool belt or tool pouch such as conventionally worn about the waist of various tradesmen.

Figure 5:
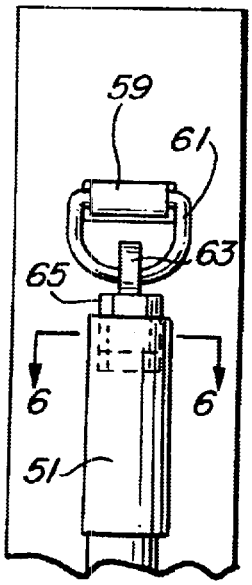
FIG. 5 is a front view of a second preferred embodiment usable with a second style of marker device.

FIG. 5 illustrates a second embodiment for use with a second type of marking device. This embodiment employs a sleeve 59 having a ring 61 pivotally mounted with respect thereto. This sleeve 59 may be attached, if desired, to a clip such as clip 17 in FIG. 1 by welding or by other attachment means. The ring 61 is inserted into a second ring 63, which is fixably attached by welding or other means to a nut 65. The insertion of ring 61 through ring 63 provides pivotal motion of the nut 65 in and out of the page.

Figure 6:
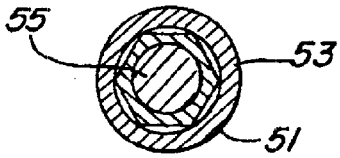
FIG. 6 is a top view of the cap of the second style marker device.

The nut 65 is particularly adapted to retain the cap 51 of the second style marking device. This cap 51 is shown in FIG. 6 and includes an outer circular rim and an inner plug 55 having a circular perimeter. A gap of annular cross section 53 is defined between the inner perimeter of the rim 51 and outer perimeter of the plug 55. The nut 65 sized to fit into this annular opening and preferably carries internal threads, which cut into and interlock with the inner plug 55 in self-tapping fashion.

An embodiment can be made that does not have a second ring (item 63). Instead, an enlarged hole is drilled in the nut 65. Also, instead of sleeve 59, it has a variation of ring 61 attached directly to the clip 17 at 90°. This configuration is a much simpler design which achieves the same result as the one in FIG. 5. Up and down flexibility is provided the same way as FIG. 5 with the side to side movement provided by the enlarged hole through nut 65 as well as the inherent flexibility provided by the clip to belt mount. An advantage of this design is that it holds the cap over the marker guard flap, whereas the style in FIG. 5 is a bit floppy.

FIG. 7 illustrates an alternate embodiment for use with the second style marking device. This alternate embodiment differs from that of FIG. 5 in that the nut 65 is provided with two pivot arms 141, 143 which are inserted into adjacent flaps 125, 126 in the manner shown and discussed with respect to FIG. 2.

FIG. 8 illustrates an alternate embodiment suitable for use with marking devices like device 39 illustrated in FIG. 2. This embodiment employs a "Chinese finger clamp" 71 to retain a marking device cap. Opposite ends of a pivot arm 75 are retained by respective flaps 25, 26. The finger clamp 71 is of such a nature that, if the cap 35 is twisted and pushed into it in one direction, the cap 35 becomes firmly gripped by the clamp 71, whereas, if the cap 35 is twisted in the same direction, and pulled out, it readily releases from the clamp 71.

FIGS. 9–11 illustrate apparatus for retaining the mounting cap of a third style marker 101. The cap 83 of this third marking device 101 is conically tapered and rounded to a top most edge 84 and has a clip 85 mounted to its side face.

The cap 83 is received and grasped by a special retainer 87 best illustrated in FIG. 10. This retainer 87 includes parallel, vertically depending side legs 93, 95 and horizontal arms 88, 89 extending from the legs 93, 95. At the top of the retainer 87, the legs 93 form into a U-shaped portion having downwardly depending arms 90, 92 attached by a cross piece 91.

To insert the cap 83 of the marking device 101 into the retainer 87, the cap 83 is inverted as shown in FIG. 11 and the clip 85 is inserted into the gap 94 between the respective arms 90, 92. The cap 83 is then rotated clockwise in the direction of the arrow 98 in order to reach the position shown in FIG. 9. The marking portion 100 of the device 101 may then be extracted from the cap for marking purposes by pulling it downwardly in the direction of the arrow 103.

Figure 12:
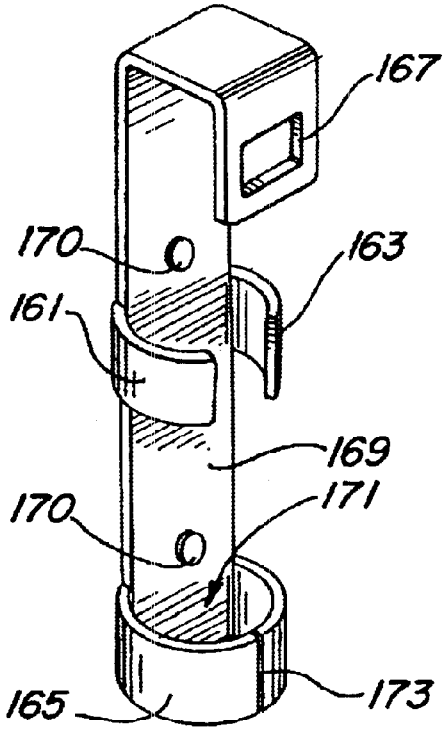
FIG. 12 is a perspective view of an alternate embodiment retainer device useable with a third style marker.
Figure 13:
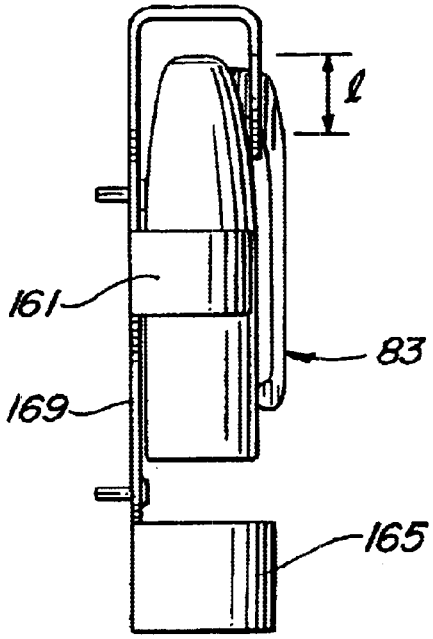
FIG. 13 is a side view illustrating the embodiment of FIG. 12.
Figure 14:
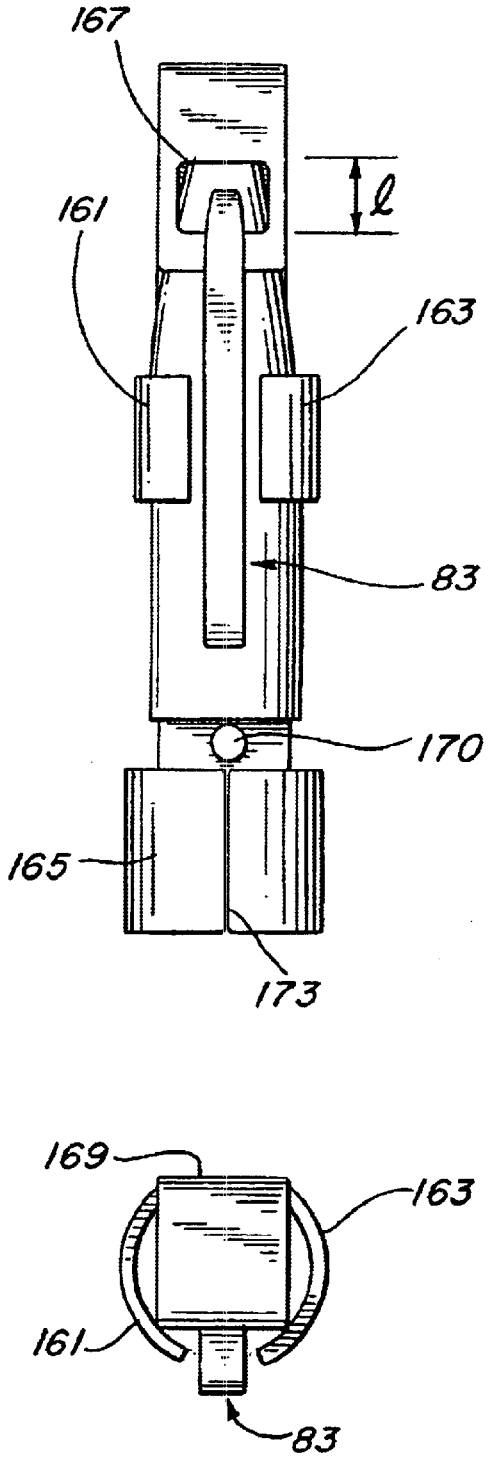
FIG. 14 is a front view illustrating the embodiment of FIG. 12.

FIGS. 12–14 illustrate another embodiment useful, for example, with the third style marker, e.g., 101. This embodiment employs arcuately shaped clip arms 161, 163, a barrel guide 165, and a pen clip receiver slot 167, all integrally formed with a vertically disposed back portion 169. Rivet holes 170 may be provided to facilitate attachment to a belt, pouch, apron or other surface, if desired. Various other attachment mechanisms, such as those illustrated herein, are of course applicable. The embodiment of FIGS. 12–14 is preferably made of metal, such as, for example, spring steel.

The barrel guide 165 provides a cylindrical opening 171 split into two halves along split 173. The barrel guide 165 provides support to the barrel, e.g. 100, of a marking device to assist in preventing inadvertent unclipping of the cap, e.g., 83. The barrel guide 165 may be omitted in various embodiments. The length "l " of the receiver slot 167 is preferably selected to accommodate various cap shapes of commercially available markers.

Figure 15:
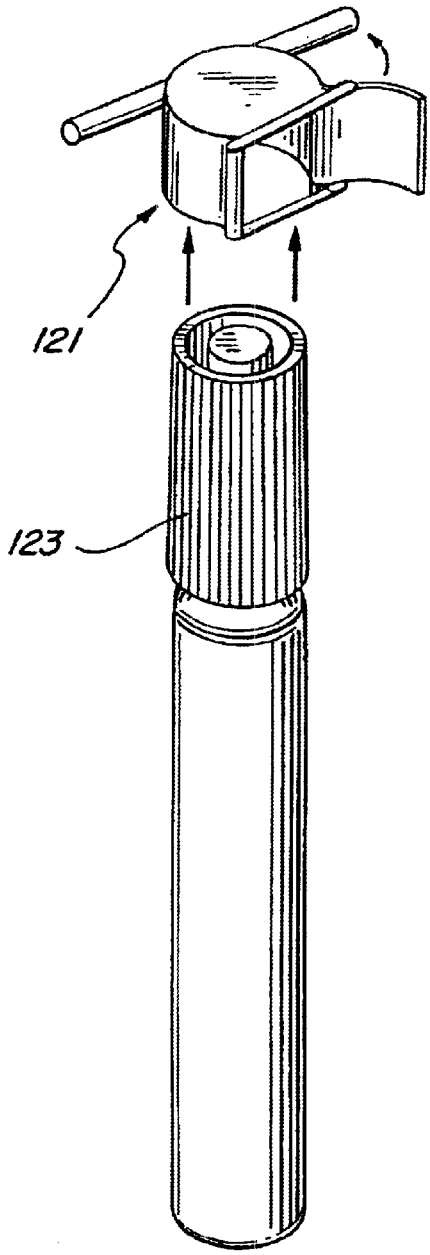
FIG. 15 is perspective view of an embodiment employing a buckle-style clamp.

The embodiments of FIGS. 1–8 provide a number of examples directed to retaining marker caps without built-in clips. These and other alternate embodiments may be described as follows:

1. Self-tapping nut. This form of attachment utilizes a machine-threaded nut that self taps onto a plastic marker cap. The threads of the nut may tap onto the outside or inside of the marker cap, depending on the particular type or brand of cap being attached. It is possible to make a multiple threaded holder to accommodate more than one brand of marker. For example, two different thread diameters may be provided, one on each end of the nut. This configuration allows the same holder to attach either Dixon or Sanford brand marks as well as many others with the same diameter cap. The outside of the holder nut may also be threaded in order to create a single holder to fit even more brands of caps. Also, a slight taper to the threads may ease tapping as well as accommodate more brands of markers. Most marker cap's inside nib cover (the round part inside the outer grip portion) are very close in diameter. Of course, pre-threaded caps may also be provided.
2. Chinese finger trap style, e. g. FIG. 7.
3. A buckle style clamp 121 such as illustrated in FIG. 15 applied around the outside circumference of a cap, e.g. 123. Such a clamp can be made adjustable to accommodate different size caps. These style clamps are common; most fire extinguishers attach to a wall bracket with such a clamp.
4. Hose clamp style and other releasable clasp styles also could fit a wide range of circumferences.
5. Encapsulated cap wherein a particular shape of cap is either partially or wholly encapsulated by a suitably shaped holder. Such an encapsulation can constitute a mated counter part into which the cap is inserted. The mated counterpart is so designed so that when the cap is fully inserted it is retained by structural features of the encapsulation device. For example, during insertion, the cap may push aside one or more flexible clips. Such a clip or clips, upon full insertion, snap over the end of the cap thereby holding the cap within the encapsulation. To remove the cap from such an encapsulation one simply pushes aside the clip or clips, thus freeing the cap for removal.

The encapsulation can contain a funnel-shaped entrance at the cap opening included in its design to ease reinsertion of the marker barrel. Such a funnel shape can also aid in securing the marker barrel against accidental dislodging.

Figure 16:
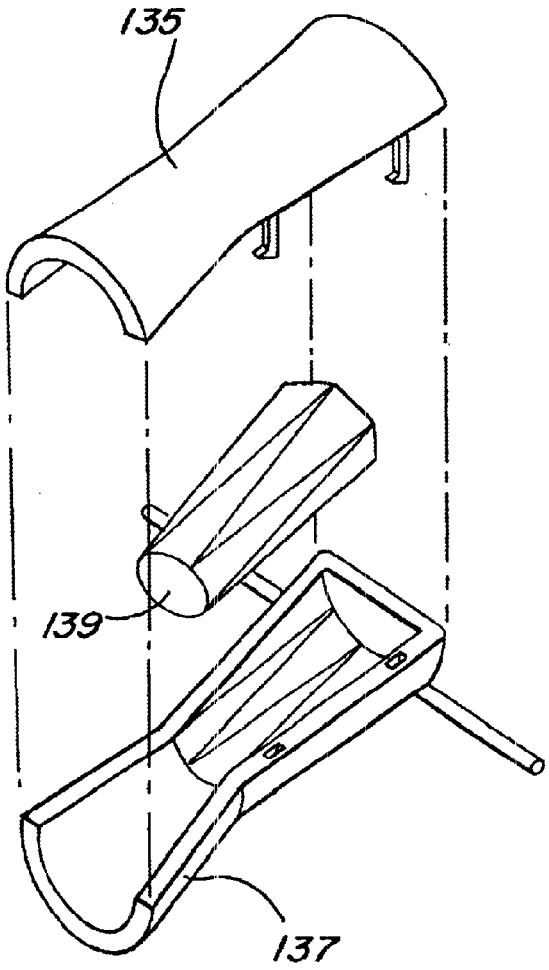
FIG. 16 is a perspective view of an embodiment employing an encapsulated cap.

Such an encapsulation can be made of one or more pieces of molded plastic or can also be made of metal or other suitable material, or a combination thereof. Other means of encapsulation are possible and readily apparent to anyone skilled in the art. An encapsulation employing halves 135, 137 as shown in FIG. 16, would snap together, thus firmly holding the cap, e.g. 139, in place. As noted, such an encapsulation could include a funnel-shaped entrance in order to make it easier to replace the marker back into the holder.

Figure 17:
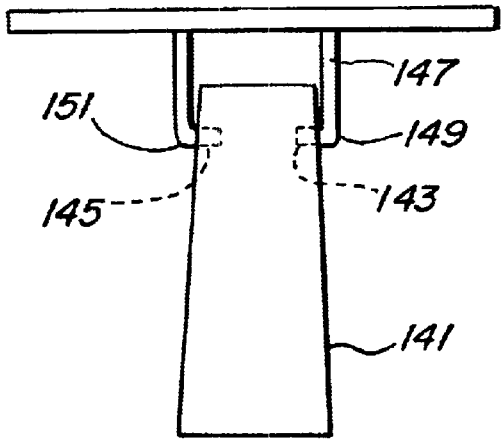
FIG. 17 is a front view of an embodiment employing a perforated cap.
Figure 18:
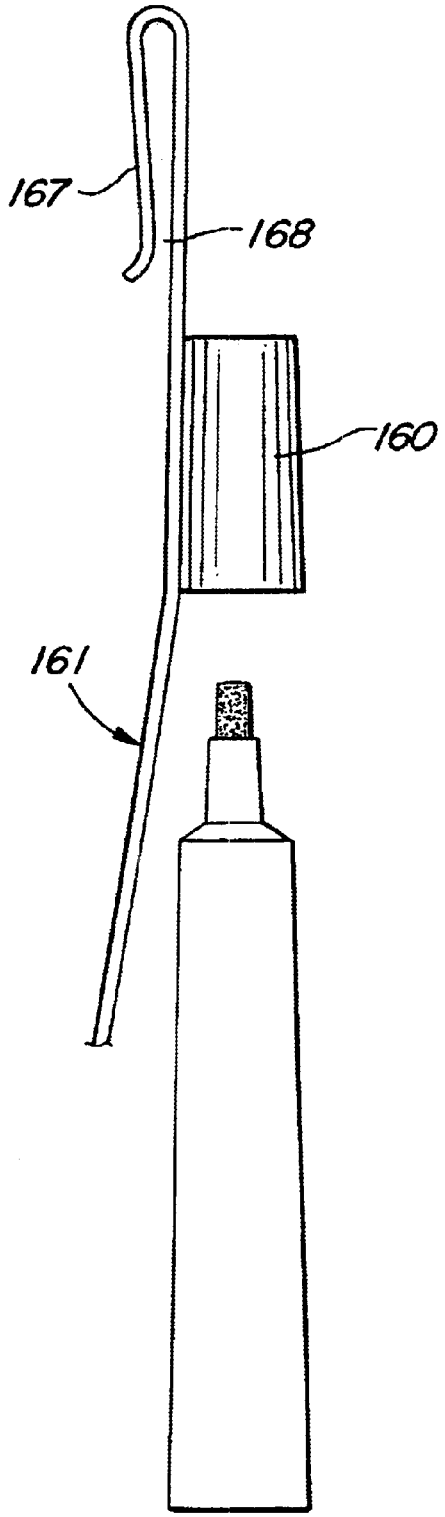
FIG. 18 is a side view of an embodiment fabricated as a molded plastic part.

6. Cap pre manufactured with one hole through the outer shell grip portion. This configuration would allow for the cap to be inserted into a socket of suitable material. A hole in the socket would then be aligned with the hole in the cap allowing the insertion of a snap or screw in order to firmly secure the cap to the socket holder.
7. A cap, such as cap 141 of FIG. 17, made with two opposing holes or indentations as 143, 145. One way of attachment is the use of a C-clip 147. The cap 141 accepts the two inwardly projecting ends 149, 151 of the clip 147, thus securing the cap 141. Another possibility, utilizing two opposing holes, would require the cap to be made with the outer shell slightly longer with two opposing holes in the lengthened portion. A rod would then be inserted through the cap.
8. Pre-molded cap with depressions or protruding clips. Either of these configurations would allow the cap to be snapped directly to a mated counterpart.
9. Permanent durable cap made of high quality durable material such as metal or other suitable material. Such a cap would be permanently or removably attached to holder. With plastic barreled markers the entire cap could be made of such material. (The plastic of the barrel provides the sealing means). Metal barreled markers would require the addition of an O-ring seal made of a suitable long lasting material such as nylon, for example.
10. One-piece plastic molded cap 160, belt-clip 167, and mark-guard 161 all in one, such as illustrated in FIG. 18. A plastic hinge 168, molded just below the clip 167 may optionally be provided for flexibility. Plastic forming and molding techniques may be applied to simplify and reduce part count and cost of various embodiments disclosed herein and variations thereof.

Figure 34:
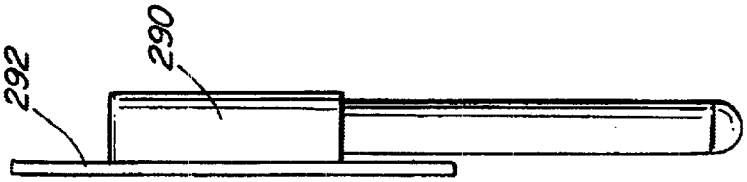
FIG. 34 is a side view of the holder of FIG. 32.
Figure 33:
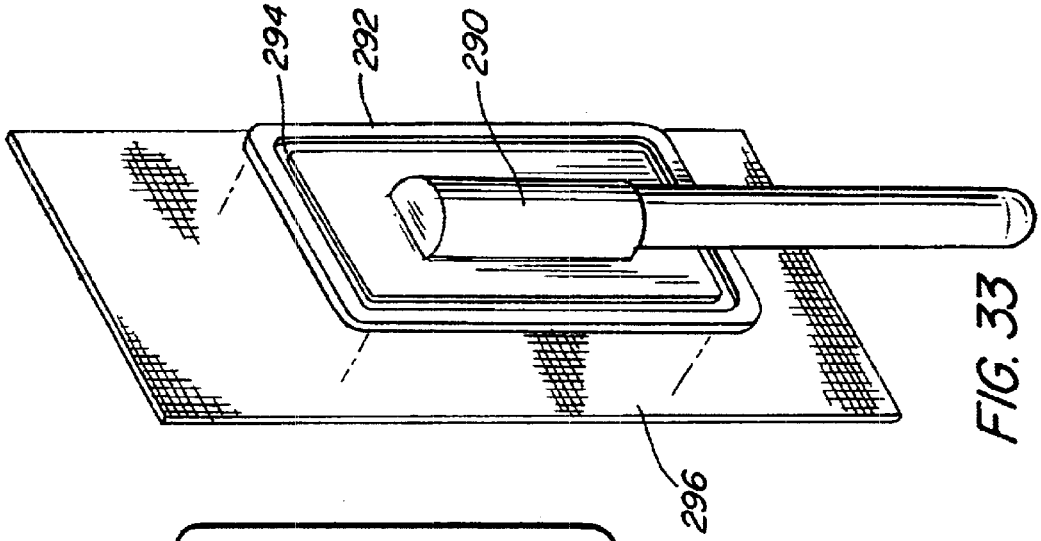
FIG. 33 is an exploded perspective view of the holder of FIG. 32.
Figure 32:
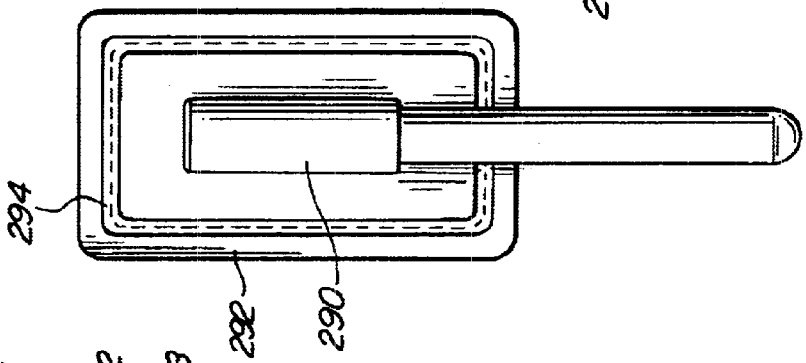
FIG. 32 is a front view of another preferred embodiment of a marker holder of the present invention having a marking device installed.

Another one-piece plastic design is illustrated in FIGS. 32–34 where a molded cap 290 is integrally formed with a body portion 292. The body portion 292 extends beneath where the marking device 39 is inserted into the cap 290 to also serve as a mark-guard. The body portion 292 preferably includes a channel 294 of thinner plastic material formed about its periphery which allows the body portion 292 to be stitched to another object or piece of fabric 296 by sewing through the thinner plastic in the channel 294. Alternatively, body portion 292 may be formed having a uniform thickness throughout which is capable of being stitched to another piece of fabric 296, where the piece of fabric could include, but is not limited to, a tool belt, apron, or any other object. The body portion 292 may alternatively include at least one hole (not shown) for accommodating rivets, screws, pins, lacing, or other similar attachment devices to provide an additional degree of attachment of the body portion 292 to the piece of fabric 296.

In yet another alternative embodiment, the plastic body portion 292 may be formed without the integral cap 290 but instead with a structure for allowing an after-market marking device cap to be clipped into and retained by the body portion 292 in accordance with any of the various embodiments of the present invention. This embodiment of the present invention still affixes the plastic body portion 292 to another piece of fabric 296 in the manner described above, but it allows for the attachment of a variety of after-market marking device caps.

Figure 19:
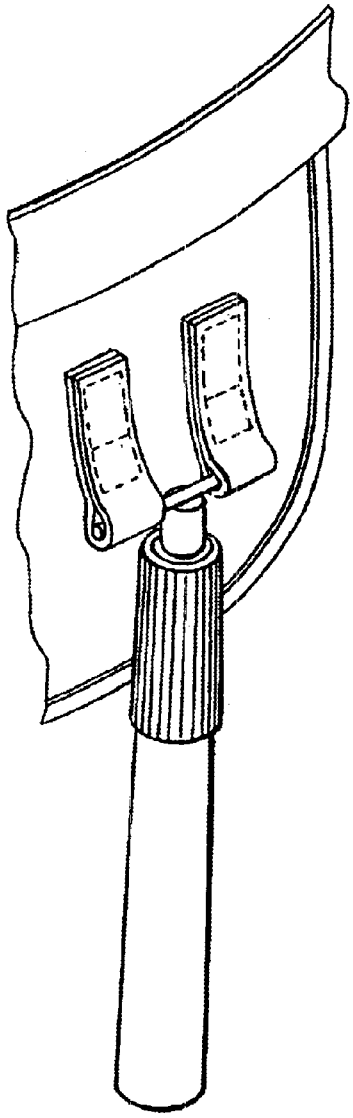
FIG. 19 is perspective view illustrating attachment of a cap-retaining device to a tool apron.

11. FIG. 19 illustrates employment of a fabric hinge or hinges as one of many possible attachment mechanisms for mounting a cap-retaining mechanism to a tool belt or apron. Other mechanisms include stiff metal or plastic protruding hinges or rings suitably attached at their base directly to the tool apron or other article of wear. Up and down movement would be provided in the same way as in the many embodiments previously described. Some degree of sideways flexibility would be inherently provided by the flexibility of the article of wear itself, but it is undesirable to have excessive sideways flexibility as sufficient stability must be maintained to allow simple one-handed removal of a marking device from the cap-retaining mechanism.

Figure 21:
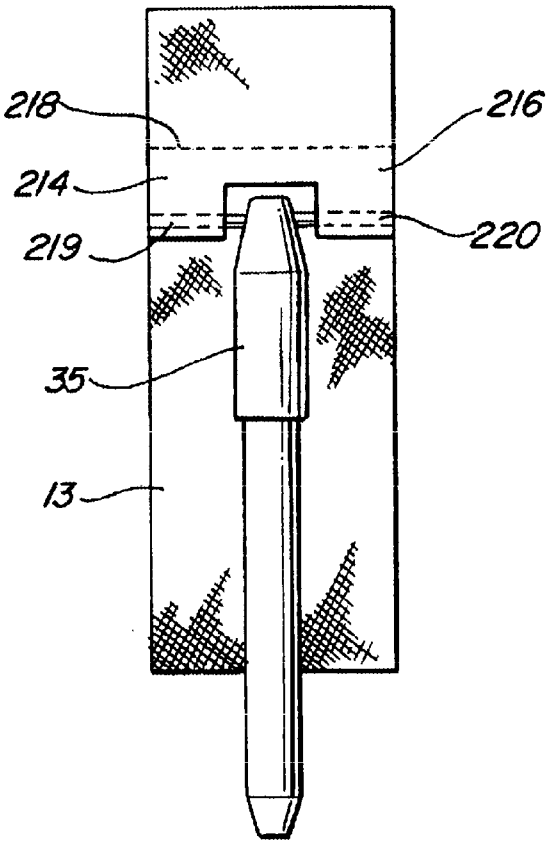
FIG. 21 is a front view of the holder of FIG. 21.
Figure 20:
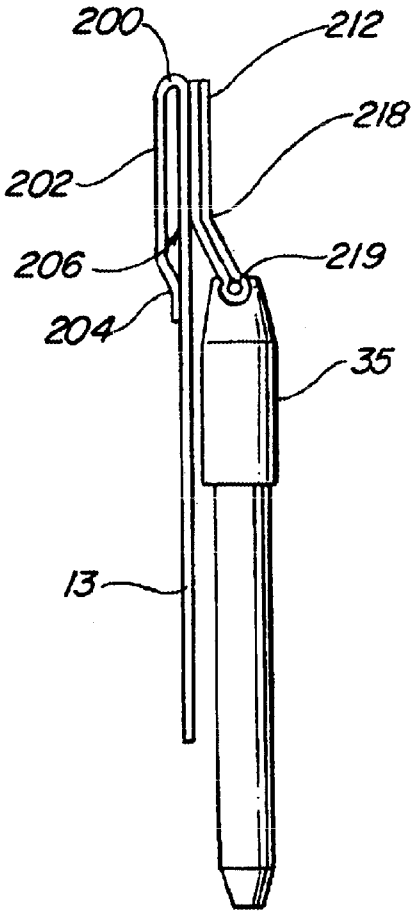
FIG. 20 is a side view of yet another preferred embodiment of a marker holder of the present invention having a marking device installed.

It should be appreciated that in each of the various embodiments of the marker holder apparatus of the present invention, the marker holder apparatus could be affixed to a belt in any number of manners. To accommodate such belt attachment, another preferred embodiment of the present invention is illustrated in FIGS. 20 and 21 where the main body piece 13 is folded at bend 200 to create downturned belt loop portion 202. The downturned belt loop portion 202 is then stitched to the main body piece 13 at stitchline 204 to create a loop 206 through which a belt may be inserted through. It is understood that the belt loop portion 202 and main body piece 13 may be affixed together in other known manners as well, including but not limited to using rivots, snaps, screws, or an adhesive epoxy.

A separate piece of fabric 212, similar to that of main body piece 13, is affixed to the main body piece 13. The piece of fabric 212 is then folded back on itself and suitably cut to create two depending flaps 214, 216, defined at their top-most edge by a stitch line 218. At the stitch line 218, the piece of fabric 212 is stitched to the portion of the main body piece 13 lying behind fabric 212. The folds of the depending flaps 214, 216 accommodate respective pivot arms 219, 220 which are arranged to retain a marker cap 35. The marker cap 35 may either be rigidly attached to the pivot arms 219, 220 or may be free to move laterally along a longitudinal direction of an axis extending through the pivot arms 219, 220.

Figure 22:
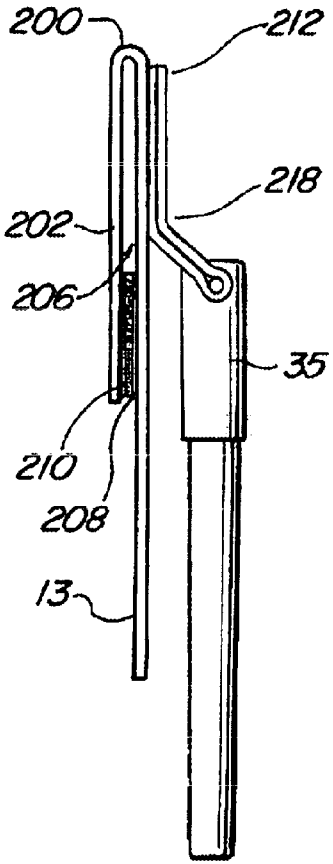
FIG. 22 is a side view of another preferred embodiment of a marker holder of the present invention having a marking device installed.

In an alternative embodiment of the present invention, the main body piece 13 and the belt loop portion 202 may be removably attached to each other, as illustrated in FIG. 22. The adjacent surfaces of the main body piece 13 and the belt loop portion 202 contain respective fastening portions 208 and 210 for removably affixing the belt loop portion 202 to the main body piece 13. The fastening portions 208 and 210 preferably comprise hooks and loops to provide a hook and loop fastener as sold under the trademark "VELCRO®." However, it is understood that other known removable fastening devices may be utilized for fastening portions 208 and 210, including but not limited to snaps and buttons. This allows the marker holder apparatus to be installed around a belt without having to remove the belt from the user. It is understood these belt fastening attachments may be utilized in combination with each of the various embodiments of the present invention described herein.

Figure 36:
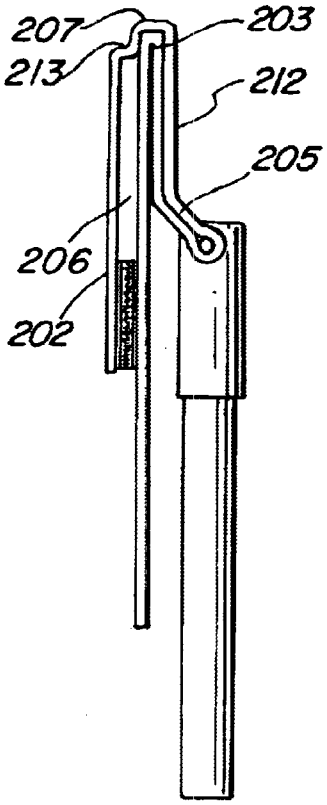
FIG. 36 is a side view of another preferred embodiment of a marker holder of the present invention.

In the above-described embodiments in which a belt loop 206 is formed, the belt loop portion 202 is described as extending from the main body piece 13. However, in an alternative embodiment of the present invention as illustrated in FIG. 36, the belt loop portion 202 may extend from the piece of fabric 212 having depending flaps 214, 216 formed therein. The upper end of the belt loop 206 is defined by stitching the belt loop portion 202 to the main body piece 13 at stitch line 213. It is also possible to form the main body piece 13, the piece of fabric 212, and the belt loop portion 202 from the same continuous piece of fabric, as shown in FIG. 36. The main body piece 13 is folded over at bend 203 to create downturned flap portion 205. The main body piece is then folded back on itself to create depending flaps 214, 216. The main body piece 13 continues to extend to bend 207 where it is folded back over itself to create downturned belt loop portion 202. The belt loop portion 202 is stitched to the main body piece 13 at stitch line 213, and the bottom of the belt loop portion 202 may either be permanently or removably affixed to the main body piece 13, depending upon the desired application for the marker holder apparatus.

Figure 24:
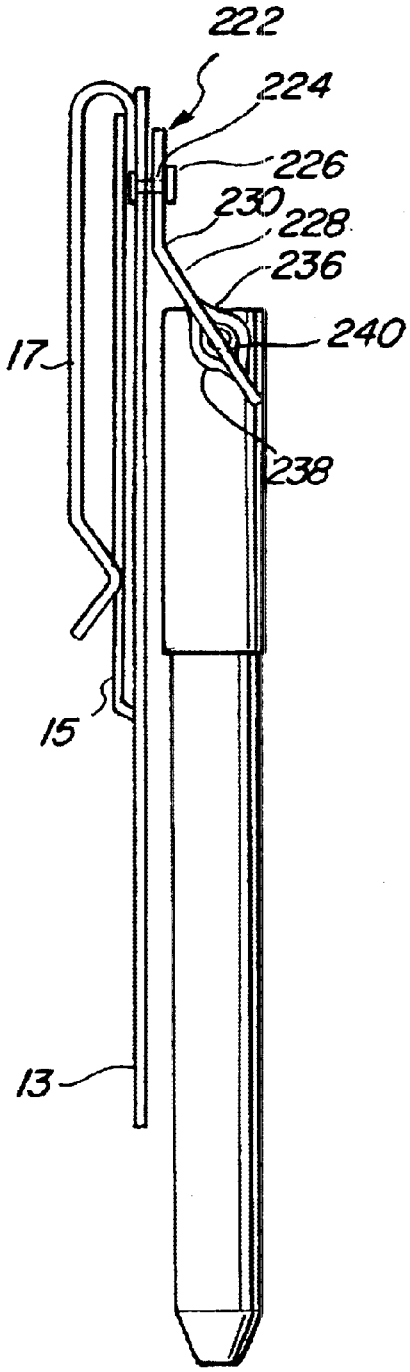
FIG. 24 is a side view of the holder of FIG. 23.
Figure 23:
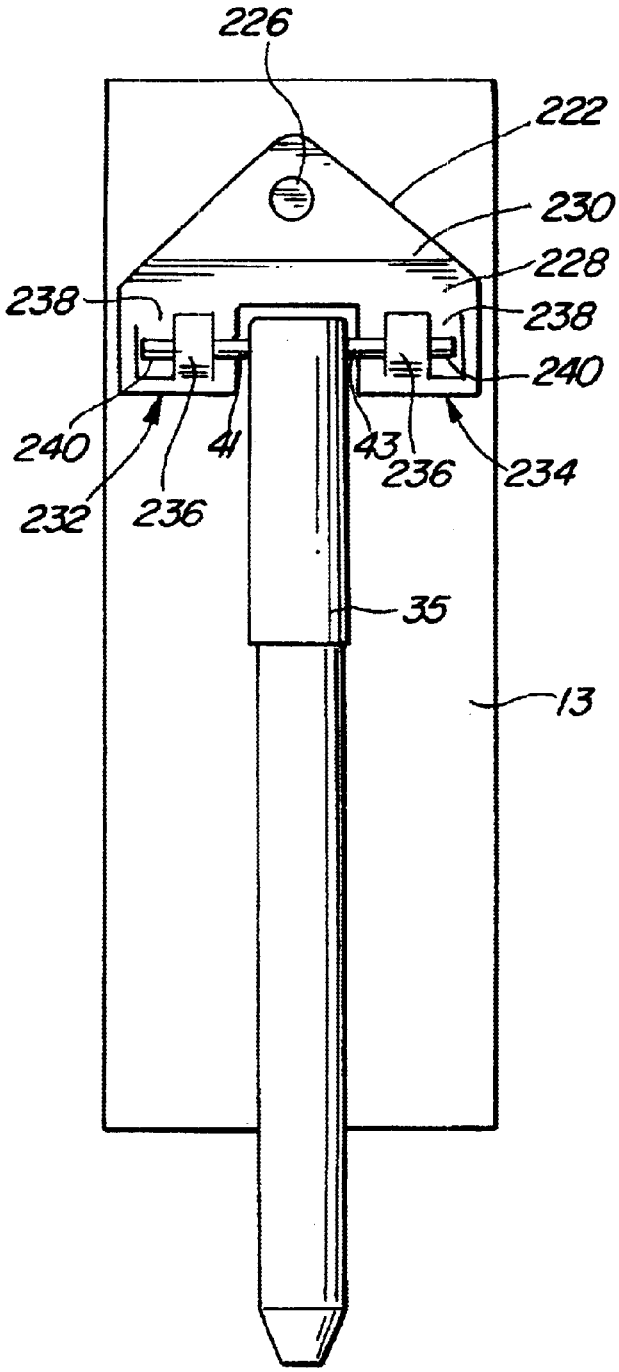
FIG. 23 is a front view of another preferred embodiment of a marker holder of the present invention having a marking device installed.

In another preferred embodiment of the present invention illustrated in FIGS. 23 and 24, a stamped metal hinge 222 may be utilized to retain the marker cap 35. The metal hinge 222 is formed as a unitary piece of metal including at least one hole 224 for accommodating a rivet 226 which affixes the metal hinge 222 to the main body piece 13. One rivet 226 may be utilized to allow the metal hinge 222 to swivel with respect to the main body piece 13, or a plurality of rivets 226 may be used to retain the metal hinge 222 in a stationary relationship with respect to the main body piece 13. The bottom portion 228 of the metal hinge 222 is angled away from the main body piece about hinge line 230. The bottom portion 228 is formed to include two flaps 232, 234. Each of the flaps 232, 234 is stamped to provide a raised rod guide 236, a depressed rod guide 238, and a rod stop 240. The raised rod guides 236 and the depressed rod guides 238 form respective co-linear channels in the two flaps 232, 234 for accepting respective pivot arms 41, 43 which are fixably attached to a metal cap 35. The co-linear channels allow for hinged attachment of the pivot arms 41, 43 and, in turn, the metal cap 35. Each of the flaps 232, 234 further includes a rod stop 240 formed at the ends of the co-linear channels for limiting the linear movement of the pivot arms 41, 43 through the co-linear channels. The metal hinge 222 may be formed of sufficiently malleable metal material to allow the rod stops 240 to be bent out of position to allow the insertion of the pivot arms 41, 43 into the co-linear channels, whereupon the rod stops 240 can be bent back into their normal movement-limiting position.

Figure 25:
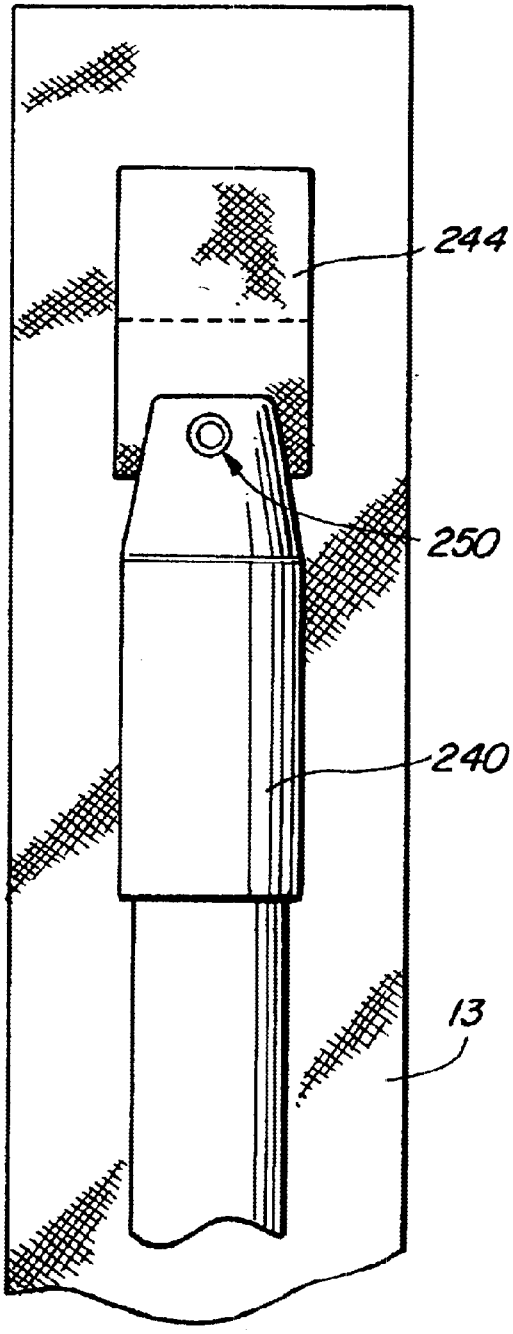
FIG. 25 is a front view of another preferred embodiment of a marker holder of the present invention having a marking device installed.
Figure 26:
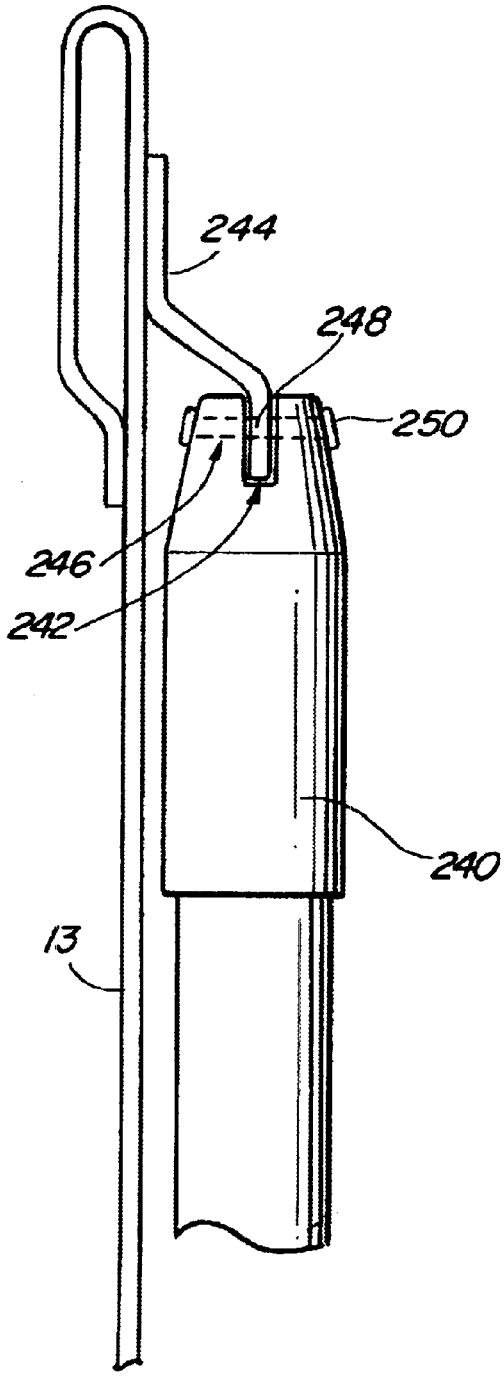
FIG. 26 is a side view of the holder of FIG. 25.

Referring now to FIGS. 25 and 26, another preferred embodiment of the marker holder apparatus of the present invention is illustrated in which a marker cap 240 is formed to include a slot 242 for use in fastening the marker cap 240 to a main body piece 13. The slot 242 is formed in the top portion of the marker cap 240 for receiving the bottom portion of a flexible attachment strip 244. The top portion of the flexible attachment strip 244 is affixed to the main body portion 13 by stitching or other suitable attachment methods. Attachment strip 244 is preferably fabricated of a flexible sturdy fabric, such as leather, cloth or synthetic material, including woven poly or nylon webbing. A passage 246 is further formed to extend through the marker cap 240 and through the slot 242 in a direction substantially perpendicular to the direction of the slot 242. A hole 248 is formed in the lower portion of the attachment strip 244 and aligned with the passage 246 to allow a rivet 250 to be inserted through the passage 246 and the hole 248 to affix the attachment strip 244 to the marker cap 240. Alternatively, rivet 250 may comprise a pin, screw or other similarly operating attachment device. The hole 248 may be reinforced with an eyelet to provide additional strength and resistance to tearing for the attachment strip 244. The rivet 250 may allow the marker cap 240 to swivel about its axis with respect to the main body device 13.

Alternatively, instead of utilizing a rivet 250 for fastening the marker cap 240 to the attachment strip 244, the marker cap 240 may be formed of a malleable material and the portions of the marker cap 240 adjacent to the slot 242 may be crimped together to engage and fixably retain the lower portion of the attachment strip 244. In order to further resist detachment of the attachment strip 244 from the crimped marker cap 240, the inner surfaces of the slot 242 may be serrated or roughened to provide a greater degree of frictional engagement between the surfaces of the slot 242 and the attachment strip 244. The end of the attachment strip 242 inserted into the slot 242 may also be folded back over on itself or may even include a rigid object, such as a metal rod, added between the folded over portion to provide an even more secure attachment to the crimped surfaces of the slot 242.

Figure 28:
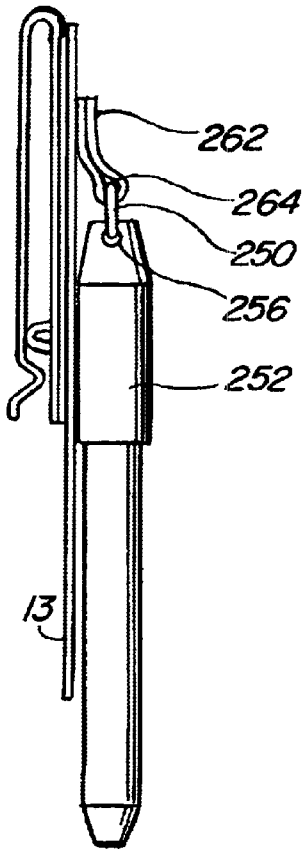
FIG. 28 is a side view of the holder of FIG. 27.
Figure 27:
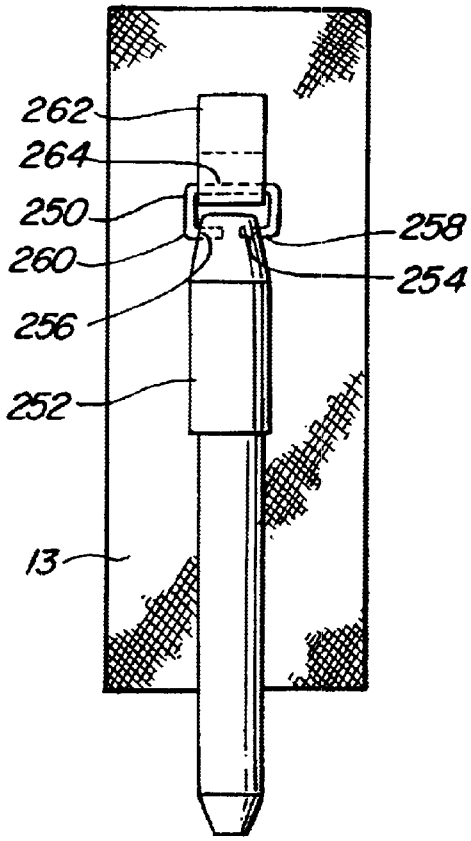
FIG. 27 is a front view of another preferred embodiment of a marker holder of the present invention having a marking device installed.

Referring now to FIGS. 27 and 28, another preferred embodiment of the marker holder apparatus of the present invention is illustrated in which a D-ring 250 is employed to retain a marker cap 252. The cap 252 includes two opposing holes or indentations 254, 256 (or a passage extending through the cap 252 having openings 254, 256) for receiving two inwardly projecting ends 258, 260 of the D-ring 250 for securing the cap 252. A piece of sturdy fabric 262, made from a similar material as that of main body piece 13, is folded back on itself and stitched to form a channel 264 as well as being stitched or otherwise affixed to the main body piece 13. The D-ring 250 may comprise any type of looped design having an opening between its projecting ends 258, 260, where the D-ring 250 is passed through the channel 264 and the projecting ends 258, 260 of the D-ring 250 are then inserted or crimped into holes 254, 256 to secure the cap 252 to the main body piece 13. The D-ring 250 could also be formed as a piece of cord which is extended through the channel 264, formed into a loop and stitched to itself or to the piece of fabric 262.

A twisting motion applied to the marking device 39 in conjunction with the force applied to remove the marking device 39 from the cap 252 will ease its removal from the cap 252. The length, thickness, and width of the fabric piece 262 is selected so as to allow some flexibility and rotation when such a twisting motion is applied to the marking device 39, while providing a limited degree of rotation with tension increasing as rotation increases in order to facilitate one-handed removal of a marking device 39 from the cap 252. The increasing tension of the fabric piece 262 with the twisting motion puts greater torque on the marking device 39 and greatly eases the removal of the marking device 39. For instance, the fabric piece 262 should allow the marker cap 252 to rotate no more than approximately 180° from its resting position when a user applies a twisting motion to remove the marking device 39 or else one-handed removal of the marking device 39 may become difficult and impractical, where the fabric piece 262 preferably keeps the degree of rotation less than 90°.

Figure 30:
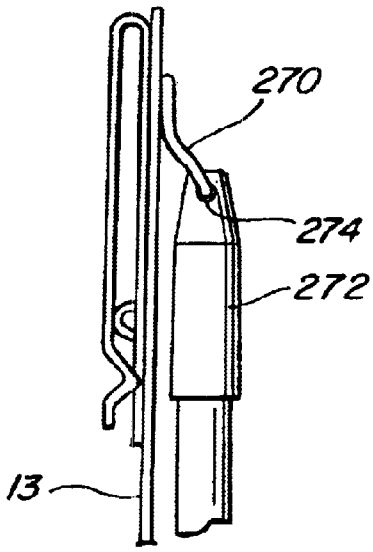
FIG. 30 is a side view of the holder of FIG. 29.
Figure 29:
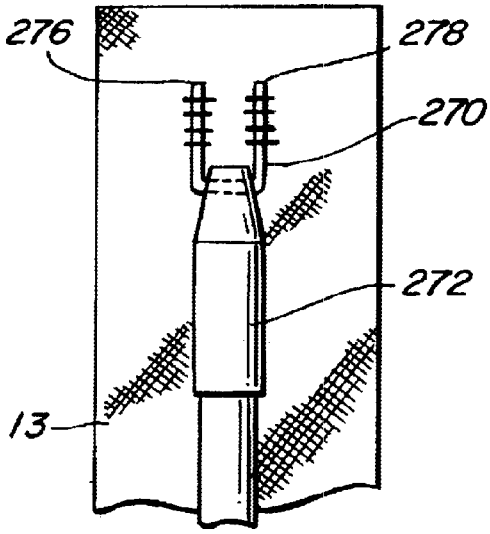
FIG. 29 is a front view of another preferred embodiment of a marker holder of the present invention having a marking device installed.

Referring now to FIGS. 29 and 30, another preferred embodiment of the marker holder apparatus of the present invention is illustrated where a piece of flexible fabric cording 270 is utilized to retain a marker cap 272. The cap 272 includes a passage 274 formed in its upper end through which the fabric cording 270 is inserted. Both ends 276, 278 of the fabric cording 270 are stitched, crimped, or otherwise attached to the main body piece 13 to secure the marker cap 272 to the main body piece 13. The length, thickness, and material used for the fabric cording 270 is selected to provide the marker cap 272 with a limited degree of rotational freedom with tension increasing as rotation increases in order to facilitate one-handed removal of a marking device 39 from the cap 272. For instance, the fabric cording 270 should allow the marker cap 272 to rotate no more than approximately 180° from its resting position when a user applies a twisting motion to remove the marking device 39 or else one-handed removal of the marking device 39 may become difficult and impractical, where the fabric cording 270 preferably keeps the degree of rotation less than 90°.

Figure 31:
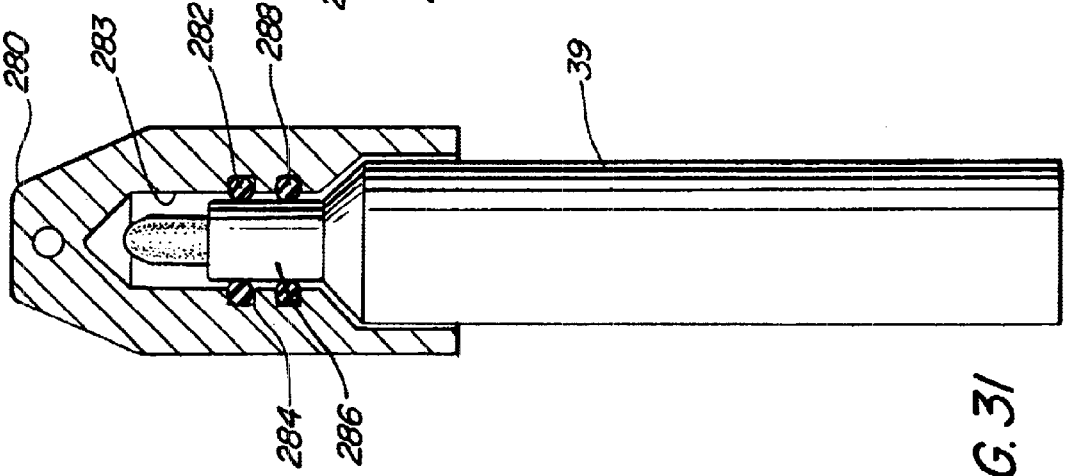
FIG. 31 is a cross-sectional front view of another preferred embodiment of a marker holder of the present invention having a marking device installed.

For certain types of marking devices, it may be necessary to provide additional attachment mechanisms within the marker cap in order to securely retain the marking devices in place. Referring now to FIG. 31, another preferred embodiment of a marker holder apparatus of the present invention is illustrated with a cross-sectional view of a marker cap 280 having such additional attachment mechanisms. The marker cap 280 includes an O-ring 282 positioned to frictionally engage an inner periphery 283 of the marker cap 280, where a groove 284 may optionally be formed about the inner periphery 283 of the marker cap 280 to receive and retain the O-ring 282. Once the marking device 39 is inserted into the marker cap 280 (as illustrated), the O-ring 282 will frictionally engage the outer periphery 286 of the tip of the marking device 39 to assist in securely retaining the marking device 39 in place. The O-ring 282 is preferably fabricated of rubber, nylon or other similar long lasting material which may sealingly engage the marking device 39.

The marker cap 280 also includes a spring clip 288 situated within its inner periphery 283 to further frictionally engage the tip of the marking device 39. Spring clip 288 may be formed of any number of coils (or fraction thereof) of a metal spring, where the coils of the spring clip 288 will tend to want to expand upon insertion of the marking device 39 and will frictionally engage the outer periphery 286 of the tip of the marking device 39 to assist in securely retaining the marking device 39 in place. The number of coils, gauge, and particular spring characteristics used for the spring clip 288 can be selected based upon the desired degree of additional attachment to be provided by the spring clip 288 to the marking device 39. It is understood that other types of springs may be utilized for spring clip 288 other than a helical wound coil spring. Furthermore, in order to provide varying degrees of additional attachment to the marking device 39, the marking cap 280 may incorporate both the O-ring 282 and the spring clip 288 together in combination, or, alternatively, may individually utilize only one of the O-ring 282 or the spring clip 288. The marking cap 280 is particularly useful in supporting marking devices of a heavier nature. The outer periphery 286 of the tip of the marking device 39 and/or the inner periphery 283 of the marking cap 280 may be shaped or molded with slots, indentations, or other engagement shapes in order to facilitate a more secure connection between the marking device 39 and the cap 280.

Figure 35B:
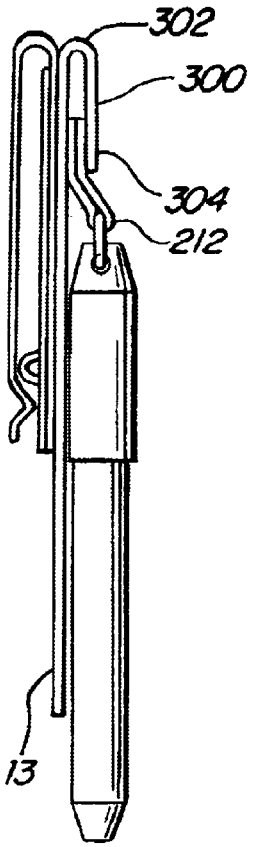
FIG. 35B is a side view of the holder of FIG. 35A.
Figure 35A:
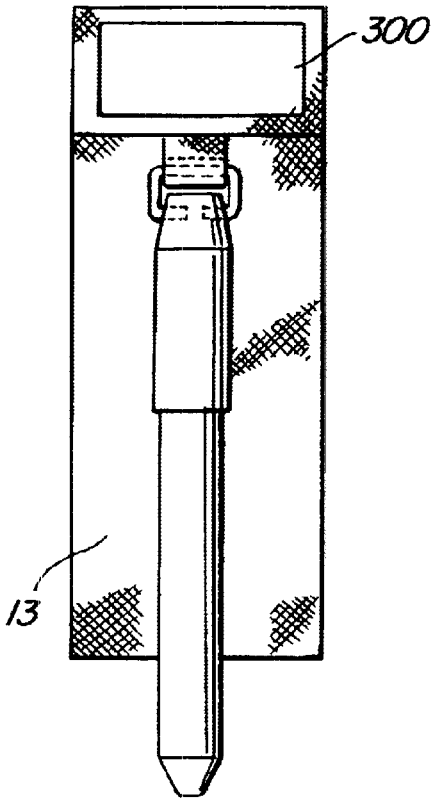
FIG. 35A is a front view of another preferred embodiment of a marker holder of the present invention.

In each of the above-described embodiments of the present invention, the marker holder apparatus may include a display area 300 on its front surface above where the marking device is being retained, as illustrated in FIG. 35A. The display area 300 may be used for providing advertising, promotional or instructional messages, or any other information. The display area 300 is located on the front surface of the main body piece 13 facing away from the article of clothing to which the marker holder apparatus is applied. In an alternative embodiment of the present invention, as illustrated in FIG. 35B, the main body piece 13 may be fold back over itself at bend 302 to form a downturned portion 304 with the display area being formed on downturned portion 304. When another piece of fabric 212 is being utilized, the display area 300 may alternatively be formed on the front surface of fabric piece 212. The display area 300 may be printing directly applied onto the marker holder apparatus or may comprise a separate piece of printing material which is affixed to the marker hold apparatus.

The marker holder apparatus of the present invention is designed to be attached to an article of clothing of a user so as to allow easy one-handed extraction and insertion of a marker device from the marker holder apparatus. It is designed to securely attach to an article of clothing without tending to tear or damage the user's clothing upon extraction or insertion of the marker device. Additionally, the marker holder apparatus is designed so as not to cause discomfort to the user during extraction or insertion of the marking device. Furthermore, the marker holder apparatus of the present invention is designed to have a predictable flexibility, so that it retains the marking device in a substantially consistent position even with the user moving about. Thus, when a user of the marker holder apparatus reaches to retrieve the marking device, the user will find the marking device in an expected, substantially consistent position (i.e., the marker device does not freely flop or move around to non-consistent positions with the movement of the user wearing the marker holder apparatus). By maintaining a substantially exact position, the marker cap is also easy for the user to locate when reinserting the marking device.

In order to provide an added degree of predictability to the position of the marking device, a retaining device may be further added to a bottom portion of the main body piece 13 for retaining a lower portion of a marking device 39 in place. Any suitable type of retaining device known to those in the art may be utilized. The following types of retaining devices are listed for illustrative purposes but are not intended to encompassed all possible types of retaining devices. The retaining device may be formed from a strip of fabric affixed to the main body piece 13 on one of its ends and which is extendible over a portion of the marking device 39 and removably affixed to the main body piece 13 on its other end. The retaining device may alternatively comprise a C-clip affixed to the main body piece 13 which the marking device clip or snaps into. The retaining device may still alternatively comprise a piece of elastic affixed to the main body piece 13 which is stretched to accommodate the marking device 39 and retain the marking device 39 in place when released. Still yet another alternative embodiment for the retaining device is a magnet affixed to the main body piece 13, where this would useful in retaining marking devices 39 of a metallic construction in place.

Figure 38:
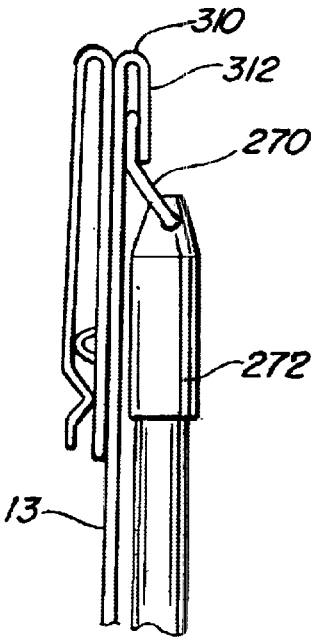
FIG. 38 is a side view of the holder of FIG. 37.
Figure 37:
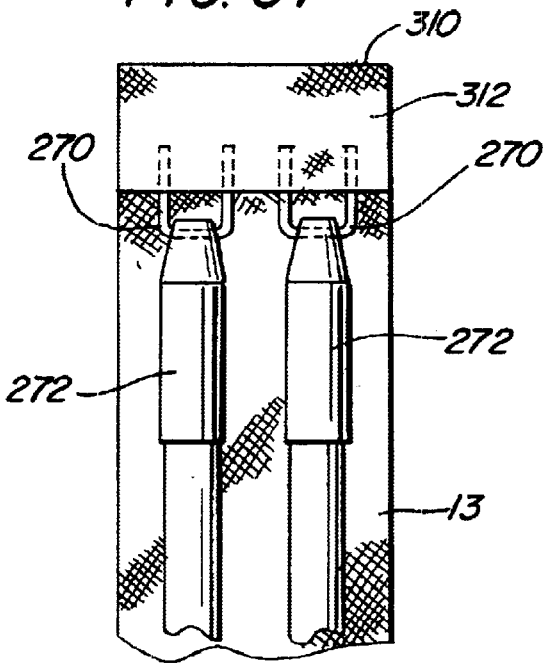
FIG. 37 is a front view of another preferred embodiment of a marker holder of the present invention.

It is the fall intention of the inventor of the present invention that each of the embodiments described herein may be easily modified to retain multiple marking devices on the same marker holder apparatus. One such arrangement for retaining multiple marking devices is shown in FIGS. 37 and 38, where marker device apparatus of FIGS. 29 and 30 has been modified to retain multiple marker caps 272. The construction is essentially the same as the previously described embodiment, with the exception that a second piece of fabric cording 270 is stitched to the main body piece 13 to retain a second marker cap 272. Furthermore, the main body piece 13 may be folded back over itself at bend 310 to create downturned flap portion 312 which extends over at least a portion of the fabric cording 270 and is stitched or otherwise affixed to the main body piece 13.

Figure 40:
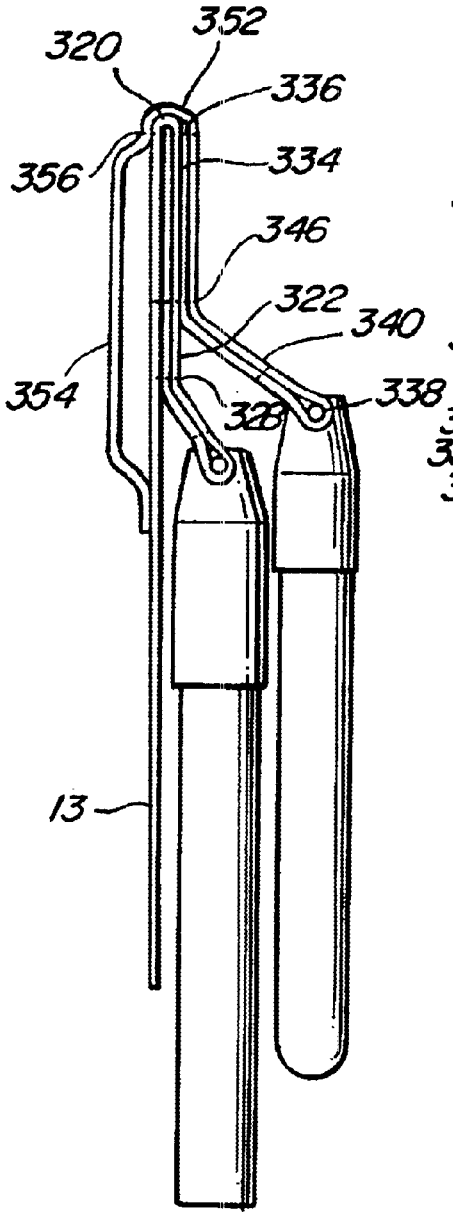
FIG. 40 is a side view of the holder of FIG. 39.
Figure 39:
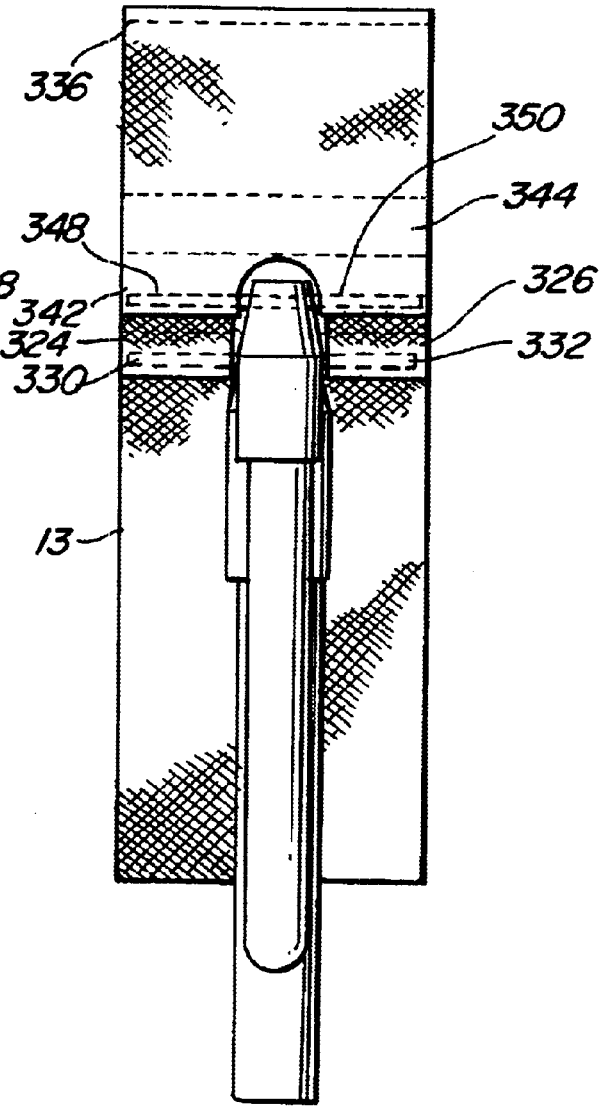
FIG. 39 is a front view of another preferred embodiment of a marker holder of the present invention.

Another example in which the marker holder apparatus can be easily modified to accommodate multiple marking devices is illustrated in FIGS. 39–40. The main body piece 13 is folded at bend 320 to create a first downturned flap portion 322. The first flap portion 322 is then folded back under itself and suitably cut to create two depending flaps 324, 326, defined at their top-most edge by a stitch line 328. At the stitch line 328, the first flap portion is stitched to the portion of the main body piece 13 lying behind flap portion 322. The folds of the depending flaps 324, 326 accommodate respective pivot arms 330, 332 which are arranged to retain a first marker cap 35.

A piece of fabric 334, similar to main body piece 13, is stitched to the first flap portion 322 at stitchline 336 and is folded back over itself at bend 338 to create a second flap portion 340. The second flap portion is suitably cut to create two depending flaps 342, 344, defined at their top-most edge by a stitch line 346. At the stitch line 346, the second flap portion 340 is stitched to the first flap portion 322. The folds of the depending flaps 342, 344 accommodate respective pivot arms 348, 350 which are arranged to retain a second marker cap 352. The fabric piece 334 continues to extend to bend 352 where it is folded back over itself to create downturned belt loop portion 354. The belt loop portion 354 is stitched to the main body piece 13 at stitch line 356, and the bottom of the belt loop portion 354 may either be permanently or removably affixed to the main body piece 13, depending upon the desired application for the marker holder apparatus. The first marker cap 35 and the second marker cap 352 may either retain similar marking devices or diverse marking devices. It is understood that each of the various embodiments of the present invention may be modified to retain any number of a plurality of marking devices.

Those skilled in the art will appreciate from the many illustrative embodiments disclosed above that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An apparatus comprising:

means attachable adjacent the body of a user for retaining a marking device cap while a marking portion of the marking device is extracted from the cap and for enabling one-handed extraction and insertion of said marking portion into and out of said cap without exerting forces tending to tear the user's clothing;

means disposed adjacent said marking device for protecting the clothing of the user from accidental marking during one-handed insertion and extraction of said marking portion; and said means for retaining and enabling further mounting said marking device such that said device is pivotable outwardly and away from said means for protecting.

2. The apparatus of claim 1 wherein said means for retaining further functions to interlock with said marking device cap.

3. The apparatus of claim 1 wherein said enabling means enables attachment of the retaining means about the waist of a user.

4. The apparatus of claim 1, wherein said means for protecting comprises a fabric portion.

5. The apparatus of claim 1 wherein said retaining means comprises an interior shaped to retain at least a portion of said cap.

6. The apparatus of claim 1 wherein said retaining means comprises at least one projection for engaging a depression or opening in said cap.

7. The apparatus of claim 1 wherein said retaining means and means enabling attachment are formed as a single piece, molded plastic part.

8. The apparatus of claim 1 wherein said means enabling attachment comprises a piece of fabric attached to a tool apron.

9. The apparatus of claim 1 wherein said means for retaining comprises a nut.

10. The apparatus of claim 9 wherein said nut includes an internal threaded portion.

11. The apparatus of claim 1 wherein said marking device is pivotable through an angle of at least 90° outwardly and away from said means for protecting.

12. The apparatus of claim 11 wherein said pivoting comprises pivoting of said cap between an upward and downward position.

13. The apparatus of claim 12 wherein said pivoting comprises pivoting in a sideward manner so as to accommodate bending at the waist by the user.

14. The apparatus of claim 11 wherein said means for retaining comprises a nut.

15. The apparatus of claim 14 wherein said nut is pivotably mounted to a body portion of said apparatus.

16. An apparatus comprising:

a fabric body of rectangular shape having a front face and a back side;

a mounting clip mounted to the back side of said fabric body, said mounting clip having a closed end disposed adjacent a top edge of said body;

a portion of material extending from the front face of said fabric body and located parallel to and below said top edge;

means cooperating with said portion of material for retaining a marking device cap and for mounting said cap such that said cap is pivotable outwardly and away from said fabric body in a plane perpendicular to said fabric body; and said front face of said fabric body extending below said portion of material a distance sufficient to form an apron for preventing a marking portion releasably retained by said cap from marking on apparel of a user when said marking portion is removed from said cap.

17. An apparatus comprising:

a main body portion having a front face and back side;

a mounting device connected to the back side of said main body portion for mounting said apparatus on a user;

a cap for retaining a marking device;

a retaining device arranged on the front face of the main body portion for retaining said cap in a pivotal manner so that said cap is pivotable about a substantially predictable axis of rotation.

18. The apparatus of claim 17, wherein said retaining device substantially maintains said axis of rotation at a predictable location of said cap at all times.

19. The apparatus of claim 17, wherein said mounting device and said retaining means substantially maintain a predictable position of said cap with respect to the user irrespective of the movement of the user.

20. The apparatus of claim 17, wherein said retaining device includes a length of fabric cording which extends through a channel formed through said cap.

21. The apparatus of claim 17, wherein said retaining device includes a metal clip which at least partially which extends through a channel formed through said cap.

22. The apparatus of claim 17, wherein said mounting device comprises a mounting clip mounted to the back side of said main body portion, said mounting clip having a closed end disposed adjacent a top edge of said main body portion.

23. The apparatus of claim 17, further comprising at least one additional retaining device arranged on the front face of the main body portion for retaining at least one additional respective cap so that said apparatus is capable of retaining a plurality of marking devices within a respective plurality of caps.

24. The apparatus of claim 17, wherein said cap includes an O-ring positioned within an inner periphery of said cap for frictionally engaging a marker device which is inserted into said cap.

25. The apparatus of claim 24, wherein said cap includes a groove formed within its inner periphery for retaining said O-ring in place.

26. The apparatus of claim 17, wherein said cap includes a spring clip positioned within an inner periphery of said cap for frictionally engaging a marker device which is inserted into said cap.

27. The apparatus of claim 26, wherein said cap includes a groove formed within its inner periphery for retaining said spring clip in place.

28. The apparatus of claim 17, wherein said front face of said main body portion extends below said cap a distance sufficient to form an apron for preventing a marking portion releasably retained by said cap from marking on apparel of a user when said marking portion is removed from or inserted into said cap.

29. The apparatus of claim 28, wherein said apron, said main body portion, and said retaining device are all formed from a continuous length of flexible fabric material.

30. The apparatus of claim 29, wherein said apron, said main body portion, said retaining device, and said mounting device are all formed from a continuous length of flexible fabric material.

31. The apparatus of claim 17, wherein said mounting device comprises a length of fabric material which forms a loop adjacent to the back side of said main body portion.

32. The apparatus of claim 31, wherein said mounting device is formed from a same piece of flexible fabric material as said main body portion, wherein said flexible fabric material extends from said main body portion and is folded back upon itself to form a loop having a closed upper end disposed adjacent a top edge of said main body portion.

33. The apparatus of claim 31, wherein a portion of said length of fabric material forming said mounting device is releasably affixed to the back side of said main body portion to form a bottom end of said loop.

34. The apparatus of claim 17, wherein said retaining device comprises first and second horizontal channels formed in respective first and second adjacent flaps extending from said main body portion and first and second retainer arms respectively mounted in said first and second channels.

35. The apparatus of claim 34, wherein said retaining device comprises a length of flexible fabric material.

36. The apparatus of claim 34, wherein said retaining device comprises an angled metal hinge.

37. The apparatus of claim 36, wherein said metal hinge retaining device is connected to said main body portion so as to be rotatable with respect to the main body portion about a connection point between said metal hinge retaining device and said main body portion.

38. The apparatus of claim 17, wherein said retaining device includes a length of flexible fabric material connected to said main body portion on one of its ends and to said cap on the other of its ends.

39. The apparatus of claim 38, wherein said cap includes a groove formed therein for receiving a portion of said length of flexible fabric material.

40. The apparatus of claim 37, wherein portions of said cap adjacent to said groove are pressed to frictionally engage said length of flexible fabric material after being inserted into said groove.

41. The apparatus of claim 39, wherein said cap further includes a channel formed therein at an angle with respect to said groove and extending through said groove, said retaining device further including a fastener extending through said channel and said portion of flexible fabric material inserted into said groove.

* * * * *